US005377541A

United States Patent [19]

Patten

[11] Patent Number: 5,377,541

[45] Date of Patent: Jan. 3, 1995

[54] GOLF CLUB GRIP TRAINING ASSEMBLY

[76] Inventor: Richard L. Patten, 2932 37th Ave., South, Minneapolis, Minn. 55406

[21] Appl. No.: 978,266

[22] Filed: Nov. 18, 1992

[51] Int. Cl.[6] ..... G01L 5/02

[52] U.S. Cl. ..... 73/379.02; 273/187.5; 273/81 D

[58] Field of Search ..... 73/379.02, 379.03; 273/81.2, 81 D, 81 R, 187.4, 187.5, 165

[56] References Cited

U.S. PATENT DOCUMENTS

| | | | |
|---|---|---|---|
| 2,133,695 | 10/1938 | Hall | 273/81 R |
| 2,311,276 | 2/1943 | Wilcox | 175/265 |
| 3,087,729 | 4/1963 | Sullivan | 273/81.2 |
| 3,111,322 | 11/1963 | English | 273/187.5 |
| 3,323,367 | 6/1967 | Searle | 273/187.5 |
| 3,670,574 | 6/1972 | Edwards | 73/379 R |
| 3,762,720 | 10/1973 | Jett | 273/187.5 |
| 3,806,130 | 4/1974 | Jacques | 273/183 D |
| 3,848,874 | 11/1974 | Elkins, Jr. | 273/183 B |
| 4,055,905 | 11/1977 | Budrose | 35/5 |
| 4,103,896 | 8/1978 | Lorang | 273/183 D |
| 4,138,118 | 2/1979 | Budney | 273/183 D |
| 4,361,326 | 11/1982 | Kokes | 273/187.5 X |
| 4,488,726 | 12/1984 | Murray | 273/183 B |
| 4,524,973 | 6/1985 | Sterbik | 273/187.5 |
| 4,635,516 | 1/1987 | Giannini | 84/1.01 |
| 4,819,939 | 4/1989 | Kobayashi | 273/81 R |
| 4,861,034 | 8/1989 | Lee | 273/81.2 X |
| 4,930,785 | 6/1990 | Mills | 273/187.5 |
| 5,221,088 | 6/1993 | McTegue et al. | 73/379.02 X |

FOREIGN PATENT DOCUMENTS

| | | | |
|---|---|---|---|
| 4253876 | 9/1992 | Japan | 273/81.2 |

OTHER PUBLICATIONS

Article, p. 154, Golf Magazine, Mar. 1991.

Promotional Material, Sport Sense, Mountain View, Calif. (undated).

*Primary Examiner*—Richard E. Chilcot, Jr.

*Assistant Examiner*—Elizabeth L. Dougherty

*Attorney, Agent, or Firm*—James D. Christoff

[57] ABSTRACT

A grip training assembly for use with a golf club includes a sensor for detecting grip pressure, a covering extending over the sensor and an indicator for indicating when the grip pressure is greater than a certain value. The sensor and the covering are relatively thin and flexible to avoid interfering with the golfer's normal grip. The covering is releasably connected to the handle portion of the club to enable the position of the sensor to be changed as desired.

11 Claims, 2 Drawing Sheets

GOLF CLUB GRIP TRAINING ASSEMBLY

BACKGROUND OF THE INVENTION

1. Field of the Invention

This invention relates to a training assembly for improving the grip on a golf club.

2. Description of the Related Art

The success of athletic endeavors that involve the use of a club, racquet or other hand-held implement is often thought to be highly dependent upon the proper grip by the athlete on the implement. Training in such endeavors typically includes attempts to change the athlete's grip on the implement in order to improve speed and direction of movement of the implement in play. While the position and orientation of the hand or hands on the implement is an important factor to consider when attempting to improve the grip, it is also recognized that the grip may be improved by changing the pressure of various portions of the hand or hands on the implement.

In golf, for example, professionals and amateurs alike recognize the benefit of ensuring that the grip pressure exerted by the hand away from the target (that is, the "off-target hand") is less than the grip pressure of the hand facing the target (the "target hand"). When the off-target hand pressure is less than the target hand pressure, it is likely that the target hand will be more effective as a lever in "pulling" the club through the stroke so that greater distance in the path of the ball can be attained. The off-target hand in this situation essentially follows the path governed by the target hand and functions to steady and guide movement of the club through the swing in subordinate fashion to the target hand.

However, it is often difficult for a golfer to relax the grip of the off-target hand to such an extent that the grip pressure of the target hand is greater than the grip pressure of the off-target hand. A right-handed person, for example, normally grips the club in such a manner that the right hand is the off-target hand. Unfortunately, the right hand of a right-handed person has a tendency to dominate movement of the left hand. Beginning or less-experienced golfers thus often face the problem of the off-target hand dominating club movement such that the club is "pushed" rather than "pulled" through the stroke, with the result that the target hand does not obtain sufficient leverage to move the club with enough power to enable the ball to travel a satisfactory distance.

Golf lessons sometimes involve directing the player's attention to the grip pressure exerted by both hands, so that a conscious effort can be made to relax the grip pressure of the off-target hand. Such efforts, however, are often ineffective because the golfer's arms move through a series of complex motions during the swing that may cause the grip pressures to change. Moreover, during the relatively short time span occupied by the swing, the golfer must also pay attention to other considerations such as direction of movement of the club and orientation of the club head, and as a consequence sufficient attention to the relative grip pressures may not be achieved. Many golfers attempt to apply the foregoing principles of grip pressure to the putting stroke as well as to the full swing, although successful efforts during the putting stroke are also often difficult to achieve.

Advanced golfers are often aware of the benefits of light grip pressures of the target hand. Any degree of grip pressure in the target hand that is greater than the minimum necessary to control the direction of club movement is likely to inhibit the speed of club movement, and as a result advanced golfers attempt to reduce pressures applied to the grip in the target hand. Typically, advanced golfers strive to grip the end of the club with only the last two or three fingers of the target hand. The momentum advantage achieved by such a grip is similar to that achieved by suspending a pendulum by the end of the pendulum arm rather the holding the pendulum closer to its bob.

Over the years, various devices have been proposed to train the golfer to use proper relative grip pressure. One example of such a device is described in U.S. Pat. No. 4,103,896 and includes a lever arm that is normally spaced above the outer surface of a grip of a golf club and extends along a lower portion of the grip. In use, the golfer extends the middle two fingers of the off-target hand over the lever arm, and excessive pressure of the fingers on the lever arm closes switch contacts that, in turn, activates a signal to warn the golfer that the off-target hand is exerting excessive pressure. Unfortunately, the device shown in U.S. Pat. No. 4,103,896 is somewhat unsatisfactory because the protruding lever arm essentially precludes the golfer's fingers from assuming the normal placement and orientation directly on the outer surface of the grip as would be desired during play.

Another proposed device for training the golfer to use correct grip pressure is illustrated in U.S. Pat. No. 4,138,118 and concerns, in one embodiment, a golf club having stiffly resilient steel pads buried beneath the club grip. Strain gauges on the pads are electrically coupled by cable to read-out equipment located a few feet behind the golfer for indicating variations in grip pressure. However, the device described in U.S. Pat. No. 4,138,118 is relatively complex and expensive due to the read-out equipment, and does not provide immediate feedback to the golfer as the stroke is progressing since the read-out equipment cannot be readily observed by the golfer during the stroke. Moreover, the strain gauges and steel pads cannot be readily transferred from one club to the next because the pads are located beneath the grip, with the result that a particular club must be dedicated for use with the device. Also, since the club is tethered to read-out equipment, the club cannot readily be used while playing an actual round of golf on the golf course.

SUMMARY OF THE INVENTION

The present invention is directed toward a grip training assembly for use with a golf club having a shaft with a handle portion. The assembly comprises a sensor for detecting grip pressure, and the sensor is adapted to lie on the outer surface of the handle portion in close fitting relation thereto. An indicator is operatively connected to the sensor for indicating when the grip pressure is greater than a certain value. A covering extends over the sensor, and the covering includes means for releasably connecting the covering to the handle portion such that the orientation of the sensor relative to the handle portion may be varied.

The releasable connecting means of the covering enables the sensor to be easily moved from one position to another along the handle portion, and alternatively enables the entire assembly to be readily moved from one club to another club. As a consequence, the assembly may be used by more than one golfer regardless of the differences in grip orientation between the golfers, and yet each golfer can use the assembly on the club of his or her choice. Advantageously, the assembly may be used on the club that is also the golfer's preferred club chosen for normal play, so that the golfer's stroke during training is the same as the golfer's stroke during play.

DETAILED DESCRIPTION OF THE PREFERRED EMBODIMENTS

Figures 1, 2, 5:
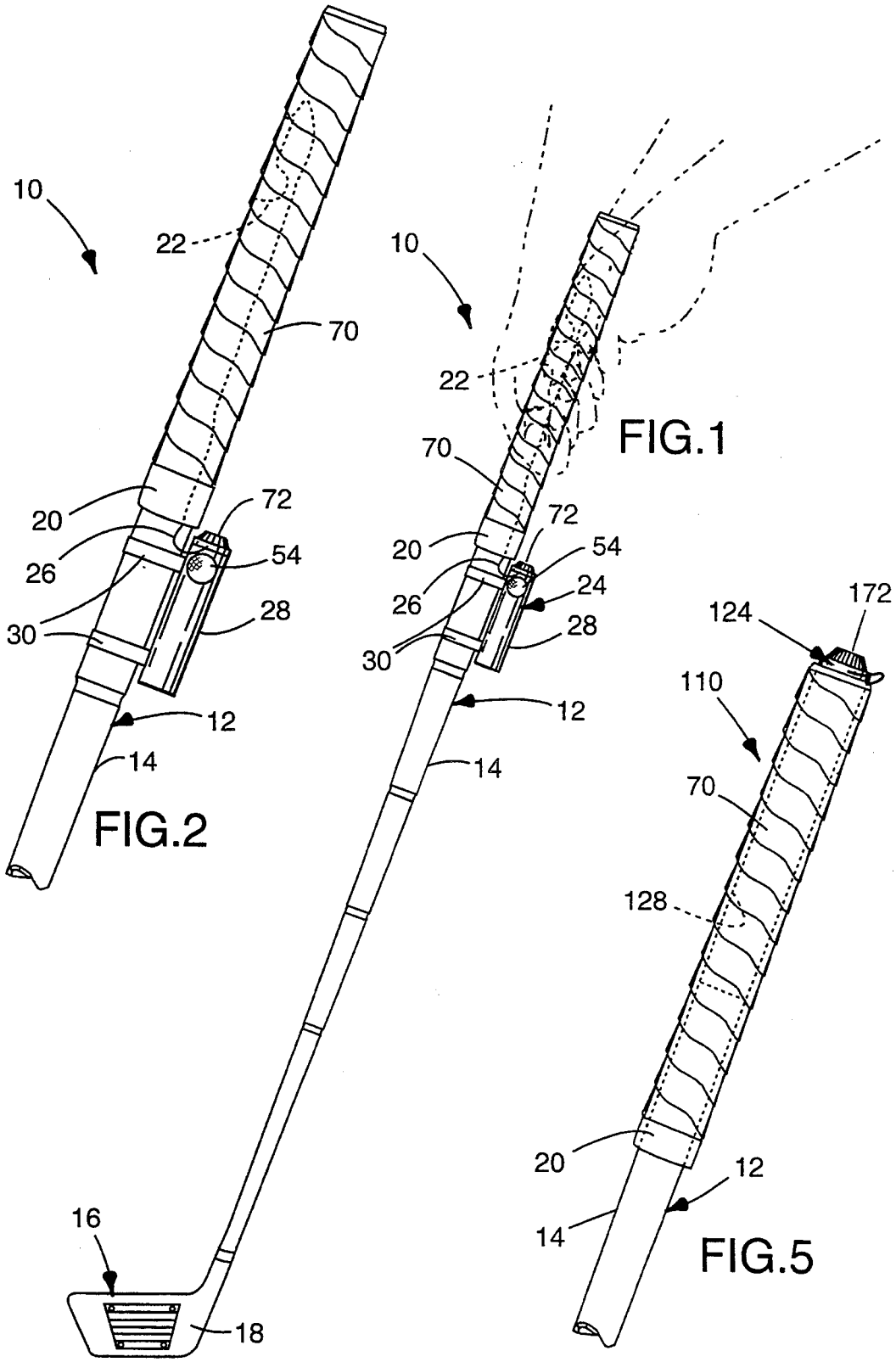
FIG. 1 is a side elevational view of a golf club gripped (in hidden lines) by an athlete and carrying a grip training assembly constructed in accordance with one embodiment of my invention.
FIG. 2 is an enlarged, fragmentary, side elevational view of the golf club and the grip training assembly illustrated in FIG. 1, with a sensor of the assembly shown in hidden lines.
FIG. 5 is an enlarged, fragmentary, side elevational view of a golf club and a grip training assembly constructed in accordance with another embodiment of my invention.

A grip training assembly 10 according to one embodiment of the invention is shown in FIGS. 1–4 and is used in conjunction with a golf club 12. The golf club 12 may be essentially any conventional, commercially available golf club, and preferably is the club used by the athlete during normal play. The club 12 includes an elongated, somewhat cylindrical shaft 14 that is normally made of a metallic material such as steel or graphite composite. The shaft 14 is connected at its lower end to a head 16 having a face 18 for hitting the golf ball.

A cushioned grip 20 is fixedly connected to the upper end portion of the shaft 14. The grip 20 as illustrated in FIGS. 1–2 is a molded, synthetic rubber composition material that is fixed to the shaft 14. An alternative construction of the grip 20 comprises a helically wound leather strip that is tightly secured to an underlisting by contact adhesive or the like, and the underlisting in turn is secured to the shaft 14.

The assembly 10 includes a sensor 22 for detecting grip pressure. The sensor 22 is a force sensitive resistor ("FSR") that provides a variable signal proportional to the amount of applied force, and normally has a flat, key-hole shaped configuration that is shown in more detail in FIG. 4. The sensor 22 preferably has a thickness less than about 0.1 inch, and more preferably has a thickness of less than about 0.03 inch to avoid interference with the golfer's normal grip. The sensor 22 is sufficiently flexible to readily conform to the generally cylindrical configuration of the outer surface of the grip 20, so that the sensor 22 lies flatly on the grip 20 without unduly protruding therefrom. A suitable FSR sensor 22 is available from Interlink Electronics (catalog no. 174) and has a thickness of about 0.011 inch.

An indicator 24 is electrically connected to the sensor 22 by wire leads 26, and indicates when the grip pressure detected by the sensor 22 is greater than a certain value (e.g., 1 to 10 lbs). The leads 26 are of relatively small gauge wire, and may be flat ribbon leads to avoid unduly interfering with the golfer's grip. The indicator 24 includes a housing 28 and two spaced apart, resilient "C" clips 30 secured to the housing 28. The "C" clips 30 releasably secure the housing 28 to the underside of the shaft 14 directly beneath the grip 20 as depicted in FIGS. 1 and 2.

Figures 3, 4:
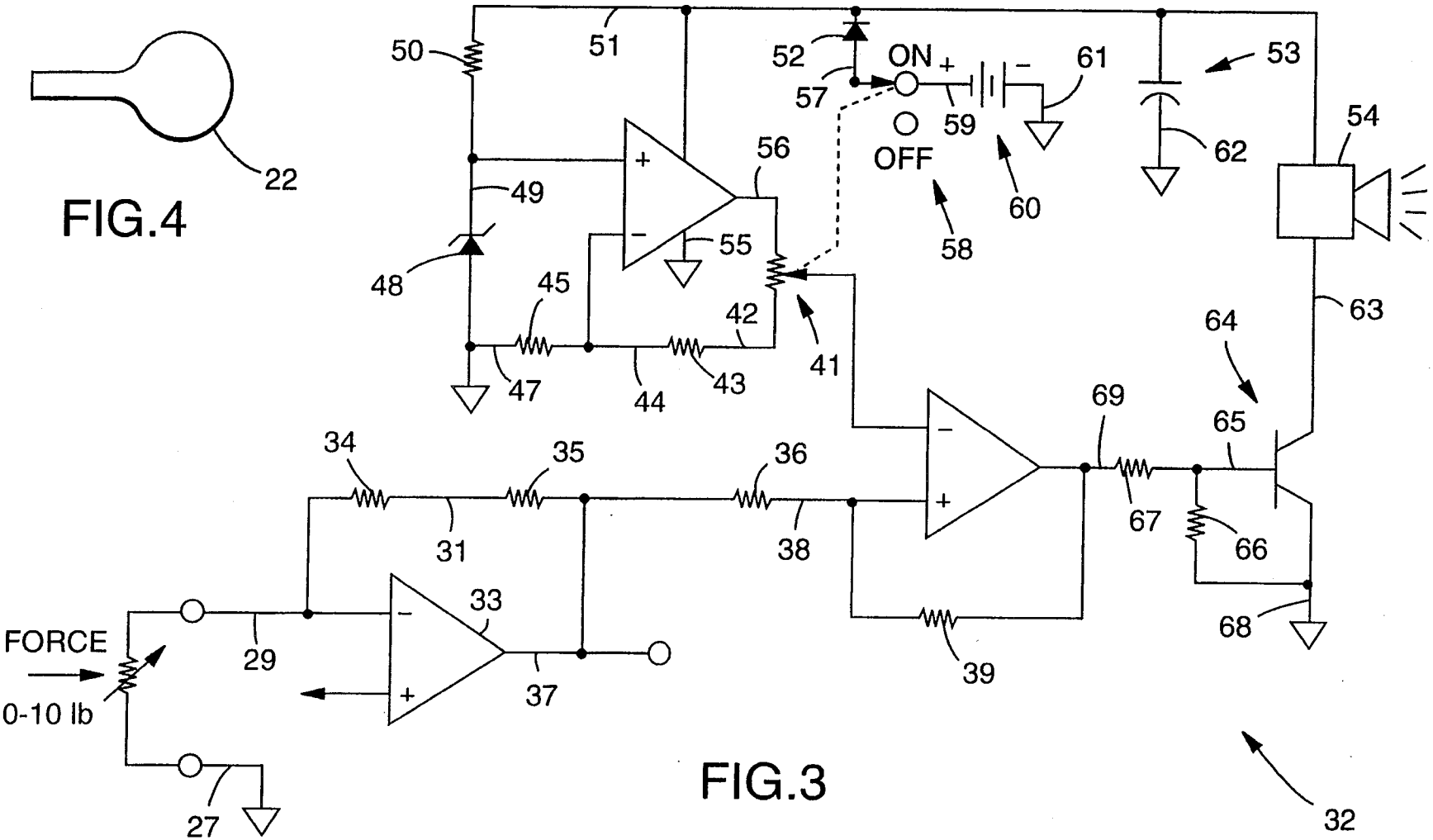
FIG. 3 is a schematic diagram of an electrical circuit of the assembly shown in FIGS. 1–2.
FIG. 4 is an enlarged plan view of the sensor of the assembly shown in FIGS. 1–3, except that the sensor is shown in a flat orientation as it would appear before connecting the sensor to the golf club.

The indicator 24 includes an electrical circuit 32 that is schematically illustrated in FIG. 3. One of the leads 26 is coupled via a lead 27 to ground, while the other of the leads is coupled via lead 29 to the inverting input (pin 2) of a quad op amp 33 (type LM 324, National Semiconductor) and a 1 K ohm resistor 34 that, in turn, is connected via lead 31 to a 5 K ohm resistor 35. An output (pin 1) of the op amp 33 is connected by a lead 37 to the resistor 35 and also to one side of a 1 K ohm resistor 36. The other side of the resistor 36 is coupled via lead 38 to a 100 K ohm resistor 39 and another non-inverting input (pin 5) of the aforementioned op amp 33.

An inverting input (pin 6) of the op amp 33 is coupled by lead 40 to the wiper of a 10 K ohm potentiometer 41. One side terminal of the potentiometer 41 is connected via lead 42 to a 1 K ohm resistor 43 that in turn is coupled by lead 44 to a 10 K ohm resistor 45 and another inverting input (pin 13) of the op amp 33. The resistor 45 is also connected by a lead 47 to ground as well as to the center terminal of a zener diode 48 (Type LM 385 BZ, National Semiconductor). A lead 49 connects a side terminal of diode 48 to two non-inverting inputs (pins 3 and 12) of the op amp 33 and to one side of a 27 K ohm resistor 50.

The other side of the resistor 50 is coupled via lead 51 to the power input terminal (pin 4) of the op amp 33, to one terminal of a Schottky diode 52 (Type IN5819), to one terminal of a 10 microfarad, 35 volt capacitor 53 and to one terminal of a self resonant alarm 54 (from Star Electronics, Catalog No. TMB-05). Pin 11 of the op amp 33 is coupled via lead 55 to ground. Another output terminal (pin 14) of the op amp 33 is connected by a lead 56 to the remaining side terminal of the potentiometer 41.

The diode 52 is also connected by a lead 57 to an on-off switch 58 that is mechanically coupled to the shaft of the potentiometer 41. The switch 58 is also connected via lead 59 to a positive side of a battery 60 (6 to 9 volts), while the negative side of the battery 60 is coupled to ground via lead 61. Also, the remaining terminal of the-capacitor 53 is connected by lead 62 to ground.

The alarm 54 is connected by a lead 63 to the collector of an NPN transistor 64 (Type 2N 4401) and the base of the transistor 64 is connected by a lead 65 to a 10K ohm resistor 66 and a 4.7 K ohm resistor 67. The 10 K ohm resistor 66 and the emitter terminal of the transistor 64 are coupled via lead 68 to ground. The 4.7 K ohm resistor 67 is connected via lead 69 to another output terminal (pin 7) of the op amp 33 and the 100 K ohm resistor 39.

The circuit 32 is located within the housing 28, and the lower end of the housing 28 has a removable threaded cap for access to a compartment that receives the battery 60. As shown in FIGS. 1–2, a knob 72 connected to the shaft of the potentiometer 41 projects through the top of the housing 28. Rotation of the knob 72 varies the amount of force that must be detected by the sensor 22 in order to activate the alarm 54, so that the indicator 24 can be adjusted as needed in accordance with the grip pressure of a particular athlete.

The assembly 10 also includes a covering 70 that extends over the sensor 22. The covering 70 is a relatively thin, sheet-like material, preferably less than about 0.1 inch, and more preferably less than about 0.05 inch so as not to interfere with the golfer's normal grip. A means for releasably connecting the covering 70 to the grip 20 comprises an adhesive, preferably a repositionable adhesive that does not leave residue on the grip 20 when the covering 70 is removed from the grip 20. A suitable covering is a vinyl self-curing, self-adhering tape known as TGB tape (available from Markel).

In use of the assembly 10, the sensor 22 is placed over the grip 20, and then positioned in such a manner to locate the sensor 22 in an area that lies directly beneath the area where the desired portions for grip evaluation of the golfer's off-target hand are located when the golfer's hands assume the normal grip on the club 12. The sensor 22 is located in FIGS. 1-2 below the intended location of the thumb of the golfer's off-target hand, although the sensor 22 could alternatively be located, for example, below the tips of the second and third fingers of the off-target hand. The leads 26 are then extended along a path between the sensor 22 and the housing 30 along the underside of the club 12. Next, the covering 70 is helically wound around the grip 20 along substantially its entire length to cover in surrounding relation the grip 20, the sensor 22 as well as the leads 26.

Advantageously, the relatively thin sensor 22 and the overlying covering 70 add little bulk to the grip 20. The flexible nature of the sensor 22 enables the sensor 22 to assume essentially the same cylindrical shape as the shape of the underlying grip 20. As a result, the golfer when gripping the club 12 is substantially unaware of the assembly 10 and grips the club 12 in the same manner as it would be gripped in the absence of the assembly 10. If the sensor 22 need be moved to adjust the position of the sensor 22 to correspond to different portions of the golfer's hands, or if another golfer having a different grip orientation intends to use the club 12 with the assembly 10, it is relatively easy to remove the covering 70, move the sensor 22 as desired and then replace the covering 70 to render the assembly ready for another use.

Another embodiment of the invention is shown in FIG. 5 and includes an assembly 110 that is essentially similar to the assembly depicted in FIGS. 1-4, except that an indicator 124 in this instance is contained within a housing 128 that is removably located within the hollow, upper portion of the shaft 14 underlying the grip 20. The electrical circuit of the indicator 124 is similar to the circuit 32 shown in FIG. 3, except that a potentiometer corresponding to potentiometer 41 has within its knob 172 an alarm that replaces the alarm 54 shown in FIG. 3. The assembly 110 is convenient because the hidden housing 128 does not protrude and bump against other clubs when the club 12 is stored in a golf bag. Moreover, the center of gravity of the indicator 124 is advantageously located within the shaft 14.

I claim:

1. A grip training assembly comprising:

a golf club having a shaft with a handle portion, said handle portion being surrounded by a cushioned grip;

a sensor for detecting grip pressure, said sensor lying over said grip in close fitting relation thereto;

a circuit including an indicator operatively connected to said sensor for indicating when the grip pressure detected by said sensor is greater than a certain value; and a relatively thin covering surrounding said sensor and at least a portion of said grip, said covering including means for releasably connecting said covering to said handle portion such that the orientation of said sensor relative to the handle portion is variable, wherein said indicator includes a housing having means for detachably connecting to said shaft of said golf club, wherein said handle portion is hollow, wherein said indicator is received in said housing, and wherein said housing is releasably received in said hollow handle portion of said golf club.

2. The assembly of claim 1 wherein said covering comprises a length of tape that is spiral-wound about the handle portion.

3. The assembly of claim 2 wherein said tape includes a releasable adhesive.

4. The assembly of claim 1 wherein said sensor comprises an electronic sensor that provides a variable signal proportional to the amount of force sensed.

5. The assembly of claim 4 wherein said sensor is a force sensitive resistor.

6. The assembly of claim 1 wherein said indicator includes at least one clip for releasably connecting said indicator to the shaft of the golf club.

7. The assembly of claim 1 wherein said indicator comprises an audible alarm.

8. The assembly of claim 1 wherein said covering is a relatively thin, sheet-like covering.

9. The assembly of claim 1 wherein said sensor is flexible for conforming to the configuration of the handle portion.

10. The assembly of claim 1 wherein said covering is less than about 0.1 inch thick.

11. The assembly of claim 1 wherein said circuit is carried by said housing, said circuit including a potentiometer for varying the amount of said certain value, said handle portion including an end, said potentiometer extending through said end of said handle portion for access.

* * * * *